US006313714B1

(12) United States Patent
Junker et al.

(10) Patent No.: US 6,313,714 B1
(45) Date of Patent: Nov. 6, 2001

(54) WAVEGUIDE COUPLER

(75) Inventors: Gregory P. Junker, El Segundo; Vrage Minassian, Burbank, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/418,869

(22) Filed: Oct. 15, 1999

(51) Int. Cl.[7] ..... H01P 5/12; H01P 3/127
(52) U.S. Cl. ..... 333/125; 333/21 R; 333/137
(58) Field of Search ..... 333/21 A, 21 R, 333/125, 137, 126, 135

(56) References Cited

U.S. PATENT DOCUMENTS 3,978,434 * 8/1976 Morz et al. ..... 333/135

OTHER PUBLICATIONS

Farr, Mode Converter (Abstract) (No. 576,842), vol. 659, p. 587, Official Gazzette, Jun. 10, 1952.*

"Wide–Band Communication Satellite Antenna Using a Multifrequency Primary Horn;" Hiroyuki Kumazawa, Masaki Koyama and Yoshio Kataoka; *IEEE Transactions on Antennas and Propagation*, May 1975; pp. 404–407.

* cited by examiner

*Primary Examiner*—Robert Pascal
*Assistant Examiner*—Stephen E. Jones

(74) *Attorney, Agent, or Firm*—Antonelli, Terry, Stout & Kraus, LLP

(57) ABSTRACT

A first embodiment of a waveguide coupler (10) has a substantially square cross-section with a width tapering from a first width a at a first end (12) to a smaller width b at a second end (14). Each side of the square waveguide coupler is provided with a turnstile port (16). The first end is coupled to a first waveguide (18) to couple the turnstile ports with the first waveguide, while the second end is coupled to a second waveguide, coupling the first and second waveguides together. Signals throughout the waveguide coupler's lower frequency band can be coupled between the turnstile ports and the first waveguide, while signals throughout the higher end of the frequency band can be coupled from the first waveguide to the second waveguide, and signals within the frequency band can be coupled from the second waveguide to the first waveguide. A second embodiment (24) includes a first waveguide coupling section (26) having a first end (30) with a substantially circular cross-section which is connected to a circular first waveguide (40), and a second end (32) with a substantially square cross-section. A second waveguide coupling section (28) has a configuration like waveguide coupler (10) of the first embodiment. The larger end of the second waveguide coupling section is coupled to the first waveguide coupling section to couple the turnstile ports with the first waveguide. The second of the second waveguide coupling section is coupled to a square second waveguide to couple the first and second waveguides together.

6 Claims, 1 Drawing Sheet

WAVEGUIDE COUPLER

FIELD OF THE INVENTION

The present invention pertains to a waveguide coupler. More particularly, the present invention pertains to a square symmetric orthomode waveguide coupler for wide band cellular applications.

BACKGROUND OF THE INVENTION

Modern communication techniques have increased the amount of high frequency radio communication significantly. By way of examples, cellular phones and Internet communication have added a considerable number of high frequency radio transmissions. Cellular phones and Internet communication involve transmission of signals from a ground location to a satellite, and retransmission of the signals from the satellite to another ground location either directly or by way of one or more other satellites. The usage is compounded, since both cellular phones and Internet communication involve two-way communication. The satellite functions of up link signal reception and down link signal transmission within a coverage area using reflector antenna systems require feed systems capable of supporting dual frequency and dual sense polarization. The down link signal transmission is generally at a fairly high power, and so requires low power loss. In addition, the ability to cover a band of from 17.5 GHz to 20 GHz is needed. As a result of all this, wider bandwidth is highly desirable.

SUMMARY OF THE INVENTION

The present invention is a square symmetric orthomode waveguide coupler which allows broad band down link dual sense polarization transmission at one frequency band, while simultaneously accepting up link dual sense polarization signal transmission at another frequency band. The present invention takes advantage of the increased separation distance with respect to frequency between the dominant $TE_{01}$ rectangular waveguide mode and that of the next higher order rectangular waveguide mode relative to that of the separation distance and frequency between the dominant $TE_{11}$ circular waveguide mode and the next higher order circular waveguide mode. Consequently, the square symmetric orthomode coupler of the present invention can operate over a wider frequency band then can a circular symmetric orthomode coupler. Furthermore, the rectangular waveguide circular polarized $TE_{01}$ mode created by the square symmetric orthomode waveguide coupler of the present invention can in turn be used to create broad band circularly polarized dominant $TE_{11}$ modes in a circular waveguide of the same bandwidth.

A first embodiment of the waveguide coupler of the present invention has a substantially square cross-section of a width which tapers from a first width at a first end to a second, smaller width at a second end. Each side of the square waveguide coupler is provided with a turnstile port to couple signals throughout the entire lower frequency band to or from a first waveguide connected to the first end of the waveguide coupler. In addition, signals throughout the higher frequency band can be coupled through the waveguide coupler from the first waveguide to a second waveguide connected to the second end of the waveguide coupler, and signals within the covered frequency band can be coupled from the second waveguide to the first waveguide.

In a second embodiment, the waveguide coupler of the present invention includes a first waveguide coupling section having a first end with a substantially circular cross-section and a second end with a substantially square cross-section. This second embodiment also includes a second waveguide coupling section having a substantially square cross-section with a width which tapers from a first width at a first end to a second, smaller width at a second end and with a turnstile port in each side thereof. This second waveguide coupling section is thus of a design similar to the design of the first embodiment of waveguide coupler. The first end of this second waveguide coupling section is connected to the square end of the first waveguide coupling section, preferably through a square intermediate section extending from the first waveguide coupling section square end. Signals throughout the entire lower frequency band can be coupled to and from the turnstile ports to a circular waveguide connected to the circular end of the first waveguide coupling section. In addition, signals throughout the entire higher frequency band can be coupled through the waveguide coupler from the circular waveguide to a second, square waveguide connected to the second end of the second waveguide coupling section, and signals within the covered frequency band can be coupled from the second, square waveguide to the first, circular waveguide.

BRIEF DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF PREFERRED EMBODIMENTS

Figure 1:
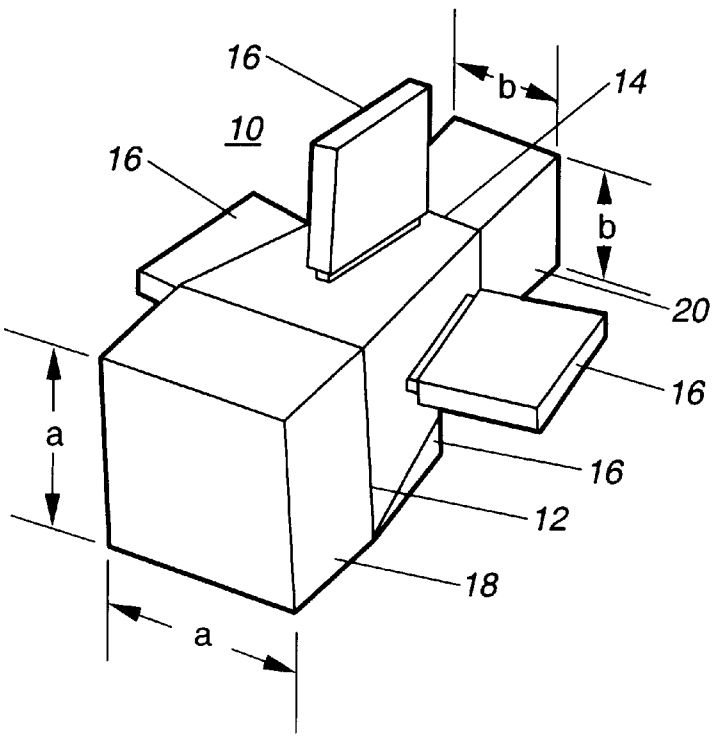
FIG. 1 is a perspective view of a first embodiment of a waveguide coupler in accordance with the present invention.

Waveguide coupler 10, depicted in FIG. 1, has a substantially square cross-section with a width which tapers from a first width a at first end 12 of waveguide coupler 10 to a second, smaller width b at second end 14 of waveguide coupler 10. Each side of square waveguide coupler 10 is provided with a turnstile port 16. First end 12 of waveguide coupler 10 is coupled to an end of a first waveguide 18 having a width a, while second end 14 of waveguide coupler 10 is coupled to an end of a second waveguide 20 having a width b.

Waveguide coupler 10 is designed for a predetermined frequency band, such as 17.5 GHz to 20 GHz. Waveguide coupler 10 can couple signals throughout the covered frequency band from turnstile ports 16 to first waveguide 18 and from first waveguide 18 to turnstile ports 16, and can couple signals at or near the higher end of the covered frequency band through the waveguide coupler from first waveguide 18 to second waveguide 20. In addition, signals within the covered frequency band can be coupled from second waveguide 20 to first waveguide 18.

Figure 2:
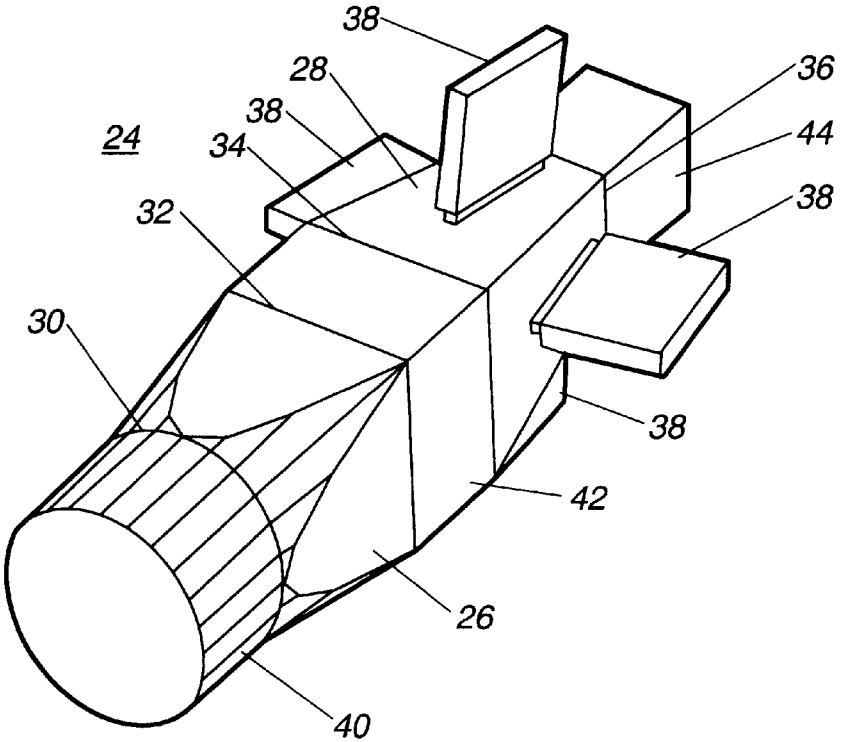
FIG. 2 is a perspective view of a second embodiment of a waveguide coupler in accordance with the present invention.

FIG. 2 depicts a second embodiment of a waveguide coupler 10 in accordance with the present invention which includes a first waveguide coupling section 26, and a second waveguide coupling section 28. First waveguide coupling section 26 has a first end 30, with a circular cross-section and a second end 32 with a square cross-section. Second waveguide coupling section 28 has a substantially square cross-section which tapers from a first width at first end 34 of second waveguide coupling section 28 to a second, smaller width at second end 36 of second waveguide coupling section 28. Each side of square, second waveguide coupling section 28 is provided with a turnstile port 38. Thus, second waveguide coupling section 28 is of substantially the same design as waveguide coupler 10 of FIG. 1.

The circular first end 30 of first waveguide coupling section 26 has substantially the same diameter as a first, circular waveguide 40 to which it is connected. The second, square end 32 of first waveguide coupling section 26 has substantially the same width as the larger end 34 of second waveguide coupling section 28 to which it is connected, preferably through a square intermediate section 42 which extends from the square end 32 of first waveguide coupling section 26. The second, smaller end 36 of square, second waveguide coupling section 28 has substantially the same width as a second, square waveguide 44 to which it is connected.

Like waveguide coupler 10 of FIG. 1, waveguide coupler 24 is designed for a predetermined frequency band, such as 17.5 GHz to 20 GHz. Waveguide coupler 24 can couple signals throughout the lower covered frequency band from turnstile ports 38 to first, circular waveguide 40 and from circular waveguide 40 to turnstile ports 38, and can couple signals throughout the higher covered frequency band through the waveguide coupler from circular waveguide 40 to square waveguide 44. In addition, signals within the covered frequency band can be coupled from second waveguide 44 to first waveguide 40.

The square symmetric orthomode waveguide coupler 10 of FIG. 1 can operate over a wider frequency band than can circular symmetric orthomode waveguide couplers. In addition, the waveguide coupler 10 can receive circular mode and linearly polarized mode electromagnetic waves from first waveguide 12 and can couple those waves through turnstile ports 22. The rectangular waveguide circular polarized $TE_{01}$ modes created by the square symmetric orthomode waveguide coupler 24 of FIG. 2 can be used to create broad band circularly polarized dominant degenerate $TE_{11}$ mode waves by means of intermediate section 26.

Although the present invention has been described with reference to preferred embodiments, various rearrangements, alterations, and substitutions can be made, and still the result would be within the scope of the invention.

What is claimed is:

1. A waveguide coupler, comprising a waveguide coupling section having a substantially square cross-section with a width tapering from a first width at a fist end of said waveguide coupling section to a second, smaller width at a second end of said waveguide coupling section, said waveguide coupling section first end being adapted to be coupled to an end of a first waveguide to receive $TE_{01}$ mode waves of a first bandwidth therefrom, each side of said square waveguide coupling section having a turnstile port therein to generate circularly polarized $TE_{01}$ mode waves of the first bandwidth, and said waveguide coupling section second end being adapted to be coupled to an end of a second waveguide to couple the first and second waveguides together such that the dominant $TE_{01}$ mode waves are cut off and circularly polarized $TE_{01}$ mode waves are coupled to circularly polarized dominant $TE_{11}$ mode waves of the first bandwidth.

2. A waveguide coupler, comprising:

a first waveguide coupling section having a first end with a substantially circular cross-section and a second end with a substantially square cross-section, said first waveguide coupling section first end being adapted to be coupled to an end of a circular first waveguide, said first waveguide coupling section being adapted to receive circularly polarized $TE_{01}$ mode waves of a first bandwidth; and a second waveguide coupling section having a substantially square cross-section with a width tapering from a first width at a first end of said second waveguide coupling section to a second, smaller width at a second end of said second waveguide coupling section, the first width being substantially equal to the width of said second end of said first waveguide coupling section, each side of said square second waveguide coupling section having a turnstile port therein, said second waveguide coupling section creating circularly polarized dominant $TE_{11}$ mode waves of the first bandwidth, said second waveguide coupling section first end being coupled to said first waveguide coupling section second end to couple said turnstile ports and the first waveguide together, and said second waveguide coupling section second end being adapted to be coupled to an end of a second waveguide to couple the first and second waveguides together.

3. A waveguide coupler as claimed in claim 2, further comprising an intermediate waveguide coupling section having square cross-section and coupling said first waveguide coupling section, and said second waveguide coupling section together.

4. A waveguide assembly, comprising:

a first waveguide having a substantially square cross-section with a first width;

a second waveguide having a substantially square cross-section with a second width less than the first width; and a waveguide coupler having a substantially square cross-section with a width tapering from the first width at a first end of said waveguide coupler to the second width at a second end of said waveguide coupler, each side of said square waveguide coupler having a turnstile port therein, said waveguide coupler first end being coupled to an end of said first waveguide to receive circularly polarized $TE_{01}$ mode waves of a first bandwidth therefrom and to couple said turnstile ports and said first waveguide together, and said waveguide coupler second end being coupled to an end of said second waveguide to couple said first and second waveguides together, said second waveguide coupling section creating circularly polarized dominant $TE_{11}$ mode waves of the first bandwidth.

5. A waveguide assembly, comprising:

a first waveguide having a substantially circular cross-section;

a second waveguide having a substantially square cross-section;

a first waveguide coupling section having a first end with a substantially circular cross-section of a diameter substantially equal to the diameter of said first waveguide, and a second end with a substantially square cross-section, said first waveguide coupling section being adapted to receive circularly polarized $TE_{01}$ mode waves of a first bandwidth, said first waveguide coupling section first end being coupled to a first end of said first waveguide; and a second waveguide coupling section having a substantially square cross-section with a width tapering from a first width at a first end of said second waveguide coupling section to a second, smaller width at a second end of said second waveguide coupling section, the first width being substantially equal to the width of said second end of said first waveguide coupling section, the second width being substantially equal to the width of said second wave guide, each side of said square second waveguide coupling section having a turnstile port therein, said second waveguide coupling section creating circularly polarized dominant $TE_{11}$ mode waves of the first bandwidth, said second waveguide coupling section first end being coupled to said first waveguide coupling section second end to couple said turnstile ports and said first waveguide together, and said second waveguide coupling section second end being coupled to an end of said second waveguide to couple said first and second waveguides together, said second waveguide coupling section creating circularly polarized dominant $TE_{11}$ mode waves of the first bandwidth.

6. A waveguide coupler as claimed in claim 5, further comprising an intermediate waveguide coupling section having a square cross-section and coupling said first waveguide coupling section and said second waveguide coupling section together.

* * * * *